US007044227B2

(12) United States Patent
Jennings et al.

(10) Patent No.: US 7,044,227 B2
(45) Date of Patent: May 16, 2006

(54) SUBSEA WELL INJECTION AND MONITORING SYSTEM

(75) Inventors: Charles E. Jennings, Houston, TX (US); Ian D. Calder, Aberdeen (GB)

(73) Assignee: Vetco Gray Inc., Houston, TX (US)

( * ) Notice: Subject to any disclaimer, the term of this patent is extended or adjusted under 35 U.S.C. 154(b) by 247 days.

(21) Appl. No.: 10/315,717

(22) Filed: Dec. 10, 2002

(65) Prior Publication Data

US 2003/0106693 A1 Jun. 12, 2003

Related U.S. Application Data

(60) Provisional application No. 60/340,056, filed on Dec. 10, 2001.

(51) Int. Cl.
*E21B 33/38* (2006.01)

(52) U.S. Cl. ..... 166/345; 166/368

(58) Field of Classification Search ..... 166/345, 166/367, 368

See application file for complete search history.

(56) References Cited

U.S. PATENT DOCUMENTS

| | | | | |
|---|---|---|---|---|
| 5,085,277 | A | 2/1992 | Hopper | |
| 5,366,017 | A | 11/1994 | Voss, Jr. | |
| 5,544,707 | A | 8/1996 | Hopper et al. | |
| 5,662,169 | A | 9/1997 | Hosie | |
| 6,186,239 | B1 | 2/2001 | Monjure et al. | |
| 6,227,300 | B1 * | 5/2001 | Cunningham et al. | 166/339 |
| 6,394,194 | B1 | 5/2002 | Queen et al. | |
| 6,516,861 | B1 * | 2/2003 | Allen | 166/351 |
| 6,705,401 | B1 * | 3/2004 | Buckle et al. | 166/337 |
| 2002/0062964 | A1 | 5/2002 | Allen | |
| 2002/0062965 | A1 | 5/2002 | Allen | |
| 2002/0062966 | A1 | 5/2002 | Allen | |

FOREIGN PATENT DOCUMENTS

| | | | |
|---|---|---|---|
| GB | 2361725 A | * | 10/2001 |
| WO | WO 02/44516 A1 | | 6/2002 |

OTHER PUBLICATIONS

U.S. Appl. No. 60/344,288, filed Dec. 28, 2001, Osborne et al.

(Continued)

*Primary Examiner*—Jennifer H. Gay
*Assistant Examiner*—Daniel P Stephenson
(74) *Attorney, Agent, or Firm*—Bracewell & Giuliani LLP

(57) ABSTRACT

A subsea wellhead assembly has the capabilities of communicating from the outer surface of an inner wellhead housing to a casing annulus. A connector, adapted to attach to a riser, connects to the outer surface of the inner wellhead housing, thereby communicating with the casing annulus. The wellhead housing has a passage extending from the casing annulus to its outer surface. The connector has a port that aligns with the passage when the connector attaches to the inner wellhead housing. Fluid can be injected through the port and the passage into the casing annulus. Casing annulus pressure can be monitored though the port and the passage. A seal ring slidingly engages the outer surface of the wellhead housing so that the passage is closed when the connector is not attached. The connector actuates the seal ring to open the passage when the connector attaches to the wellhead housing.

19 Claims, 4 Drawing Sheets

OTHER PUBLICATIONS

U.S. Appl. No. 10/077,231, filed Feb. 15, 2002, Calder et al.
U.S. Appl. No. 10/081,100, filed Feb. 21, 2002, Ward.
U.S. Appl. No. 10/037,532, filed Jan. 4, 2002, Buckle et al.
U.S. Appl. No. 60/333,550, filed Nov. 27, 2001, Clark.
To Be Assigned Nonprovisional of U.S. Appl. No. 60/333,550, filed Nov. 27, 2002, Clark.

* cited by examiner

SUBSEA WELL INJECTION AND MONITORING SYSTEM

RELATED APPLICATIONS

Applicant claims priority to the application described herein through a United States provisional patent application titled "Drill Cuttings Injection System," having U.S. Patent Application Ser. No. 60/340,056, which was filed on Dec. 10, 2001, and which is incorporated herein by reference in its entirety.

BACKGROUND OF THE INVENTION

1. Technical Field

This invention relates in general to the communication from a casing annulus to the outer wellhead housing, and more particularly to the monitoring of casing annulus pressure, the injection of drill cuttings generated from drilling a subsea well, or the injection of a heavy fluid into the casing annulus to reduce the casing annulus pressure.

2. Background of the Invention

A subsea well that is capable of producing oil or gas will have an outer or low pressure wellhead housing secured to a string of conductor pipe that extends some short depth into the well. An inner or high pressure wellhead housing lands in the outer wellhead housing. The high pressure wellhead housing is secured to an outer string of casing, which extends through the conductor pipe to a deeper depth into the well. Depending on the particular conditions of the geological strata above the target zone (typically, either an oil or gas producing zone or a fluid injection zone), one or more additional casing strings will extend through the outer string of casing to increasing depths in the well until the well is to the final depth.

The last string of casing extends into the well to the final depth, this being the production casing. The strings of casing between the first casing and the production casing are intermediate casing strings. When each string of casing is hung in the wellhead housing, a cement slurry is flowed through the inside of the casing, out of the bottom of the casing, and back up the outside of the casing to a predetermined point.

Virtually all operators monitor pressure of producing wells in the annulus flow passage between the strings of casings. Normally there should be no pressure in the annulus between each string of casing because the annular space between each string of casing and the next larger string of casing is ordinarily cemented at its lower end and sealed with a packoff. If pressure increased within an annulus between the strings of casings, it would indicate that a leak exists in one of the strings of casing. The leak could be from several places. Regardless of where the leak is coming from, pressure build up in the annulus could collapse a portion of the production casing, compromising the structural and pressure integrity of the well. For this reason, operators monitor the pressure in the annulus between the production casing and the next larger string of casing in a well.

It is advantageous to be able to have a way to efficiently communicate with a casing inside of a high pressure or inner wellhead housing. Operators need the capability to pump down a heavy fluid into the casing annulus of a well in order to reduce casing annulus pressure. It is also desirous for operators to monitor an annular pressure between the high pressure wellhead housing and a string of casing positioned inside of the wellhead housing. Furthermore, operators also desire an efficient way to inject "cuttings" into the casing annulus of the well.

When a subsea well is drilled, cuttings, which are small chips and pieces of various earth formations, will be circulated upward in the drilling mud to the drilling vessel. These cuttings are separated from the drilling mud and the drilling mud is pumped back into the well, maintaining continuous circulation while drilling. The cuttings in the past have been dumped back into the sea or conveyed to a disposal site on land.

While such practice is acceptable for use with water based drilling muds, oil based drilling muds have advantages in some earth formations. The cuttings would be contaminated with the oil, which would result in pollution if dumped back into the sea. As a result, environmental regulations now prohibit the dumping into the sea of cuttings produced from oil based muds.

There have been various proposals to dispose of the oil based cuttings. One proposal is to inject the cuttings back into a well. The well could be the well being drilled, or the well could be an adjacent subsea well. Various proposals in patents suggest pumping the cuttings down an annulus between two sets of casing into an annular space in the well that has a porous formation. The cuttings would be ground up into a slurry and injected into the porous earth formation. Subsequently, the well receiving the injected cuttings would be completed into a production well.

U.S. Pat. No. 5,085,277, Feb. 4, 1992, Hans P. Hopper, shows equipment for injecting cuttings into an annulus surrounding casing. The equipment utilizes piping through the template or guidebase and through ports in specially constructed inner and outer wellhead housings. Orientation of the inner wellhead housing with the outer wellhead housing is required to align the ports.

U.S. Pat. No. 5,662,169, Sep. 2, 1997, Stanley Hosie, shows equipment with specially manufactured extensions attached between the lower portions of both the inner and outer wellhead housings and the upper portions of the casings hanging therefrom. Each of the extensions have ports that must align in order for the cuttings to communicate through the inner and outer wellhead housings to an annular space inside of the inner wellhead housing. A swivel joint on the extension of the inner wellhead housing supports the casing hanging therefrom while allowing rotation of the inner casing above the swivel joint for aligning ports extending through each of the inner and outer wellhead housings.

U.S. Pat. No. 6,394,194, May 28, 2002, Michael Queen et al., shows equipment with a port formed in a collar that aligned with a passage in an inner wellhead housing above the outer wellhead housing. Having the communication port in the collar positioned above the outer wellhead housing was one way to remove the necessity of aligning a port on the inner wellhead housing with a port on the outer wellhead housing. The collar, however, had to be aligned with the passageway opening to the outer surface of the inner wellhead housing, and then the injector system had to align with the port formed in the collar. This necessitated the use of two brackets that had to land around the inner wellhead housing after the inner wellhead housing had landed.

U.S. Pat. No. 5,366,017, Nov. 22, 1994, Robert K. Voss, Jr., and U.S. Pat. No. 5,544,707, Aug. 13, 1996, Hans P. Hopper et al., both show equipment for monitoring casing annulus pressure. The inventions disclosed in both of these patents show equipment that has the casing annulus pressure communicating to a point above the high pressure wellhead housing on the exterior of a tree assembly that has landed on the high pressure wellhead housing. Various systems have been utilized in order to prevent the casing annulus from communicating until the tree assembly lands on the high pressure wellhead housing. With the equipment shown in the Hopper and Voss patents, it is difficult to monitor the casing annulus pressure before the tree assembly lands.

U.S. Pat. No. 6,186,239, Feb. 13, 2001, Noel A. Monjure et al., shows equipment for circulating heavy fluids into an annulus formed between casing strings in order to relieve casing pressure due to leaks. The invention disclosed in the Monjure '239 patent shows injecting heavy fluids into a well by lowering a flexible hose into an annulus between casing strings. Heavy fluids are pumped through the hose and into the annulus for well fluid displacement when the pressure builds up in the annulus between casing strings due to leaks in the casing.

Many of the above-mentioned assemblies require an injection assembly to be connected before a riser is attached to the wellhead assembly. Furthermore, some of the assemblies communicate with the casing annulus through passages in both the inner and outer wellhead housings. This requires that alignment of the inner and outer wellhead housings, which can add to the expense of the assembly in either time and cost of manufacture, or time and cost of installation.

SUMMARY OF THE INVENTION

A subsea wellhead assembly has the capabilities of communicating from the outer surface of an inner wellhead housing, or inner wellhead tubular member, to a casing annulus located between the inner wellhead housing and a string of casing supported by a casing hanger within the inner wellhead housing. The subsea wellhead assembly has a connector that is adapted to be attached to the lower end of a riser that connects the riser to the well. The inner wellhead housing has a grooved profile on its exterior surface. When the connector attaches to the well, the connector connects to the grooved profile on the inner wellhead housing. The casing annulus is in fluid communication with the exterior of the inner wellhead housing through a passage extending through the inner wellhead housing. A communication port extending through a side of the connector registers with the passage so that the connector is in fluid communication with the casing annulus.

Pressure within the casing annulus can be monitored at the connector through the communication port and the passage. A line can be connected to the communication port for delivering a fluid into the casing annulus. The fluid can be a slurry of injection cuttings. The fluid may also be water or some other heavy fluid.

In the preferred embodiment, a seal ring slidingly engages the exterior of the inner wellhead housing to open and close the passage. The seal ring closes the passage when the connector is not attached to the inner wellhead housing. The seal ring is actuated when the connector attaches to the inner wellhead housing. The passage is open after the connector actuates the seal ring when attaching to the inner wellhead housing. A piston actuates a locking member in the connector to matingly engage the grooves on the inner wellhead housing. The piston also actuates the connector to push the seal ring, so the passage is open, while the locking members are engaging the grooves.

In the preferred embodiment, the inner wellhead housing also has an upper channel extending from the exterior of the inner wellhead housing to its bore. The casing hanger has a lower channel extending from its outer surface to the casing annulus. The upper and lower channels register with each other such that the casing annulus is also in fluid communication with the exterior of the inner wellhead housing through the upper and lower channels. A connector channel extending through a side of the connector is in fluid communication with the upper channel. The fluid can be injected into the casing annulus through the connector, upper, and lower, channels. Casing annulus pressure can also be monitored at the connector through the connector, upper, and lower channels. In the preferred embodiment, a casing hanger tubular member extends from the casing hanger to a predetermined depth in the casing annulus. The casing hanger tubular member is in fluid communication with the lower channel. Fluid can be delivered into the casing annulus at the predetermined depth.

DETAILED DESCRIPTION OF THE PREFERRED EMBODIMENT

Figure 1:
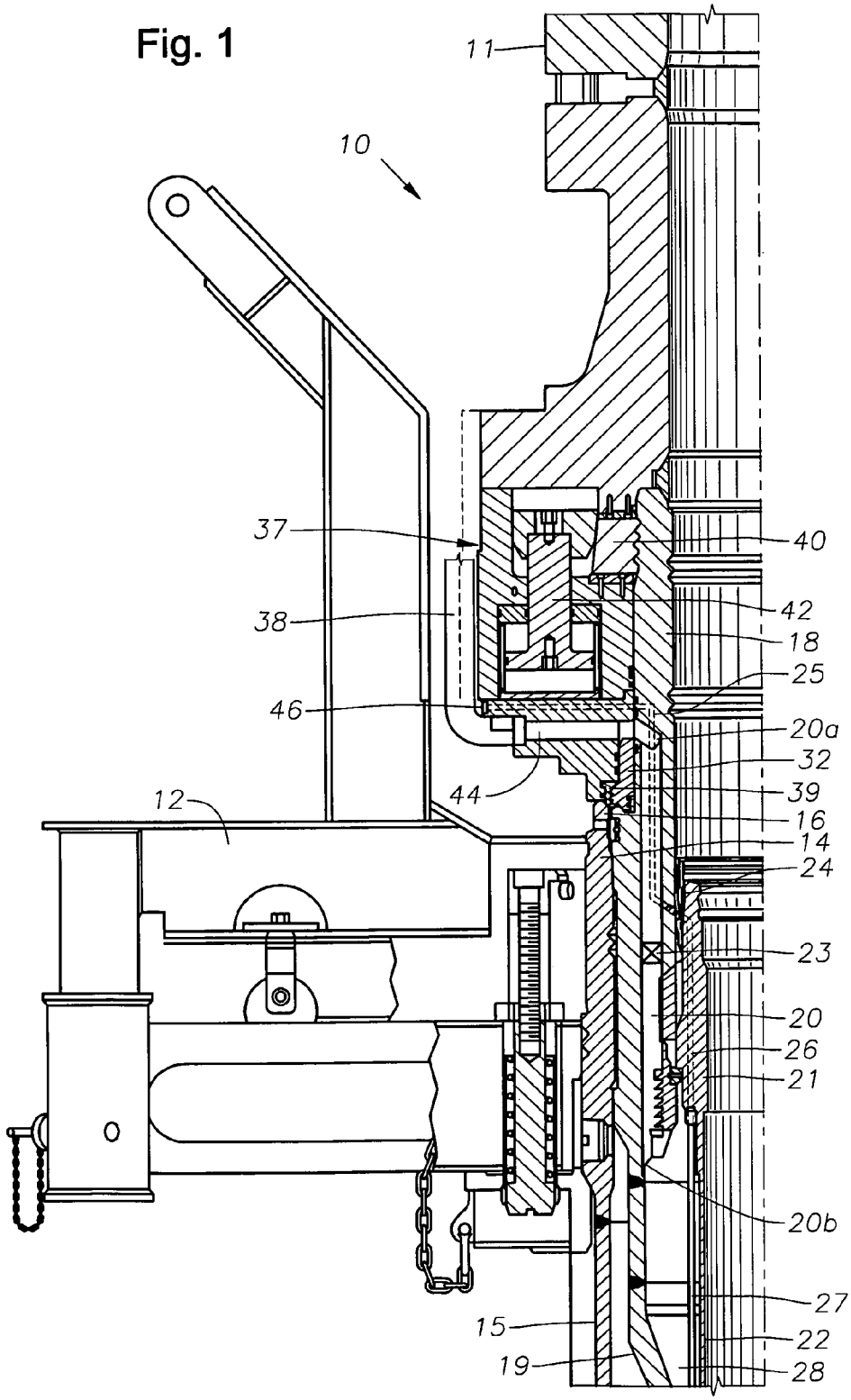
FIG. 1 is a cross section of the injection and monitoring system with the annular ring engaged by the drill cuttings injector assembly and shown in an open position.
Figure 2:
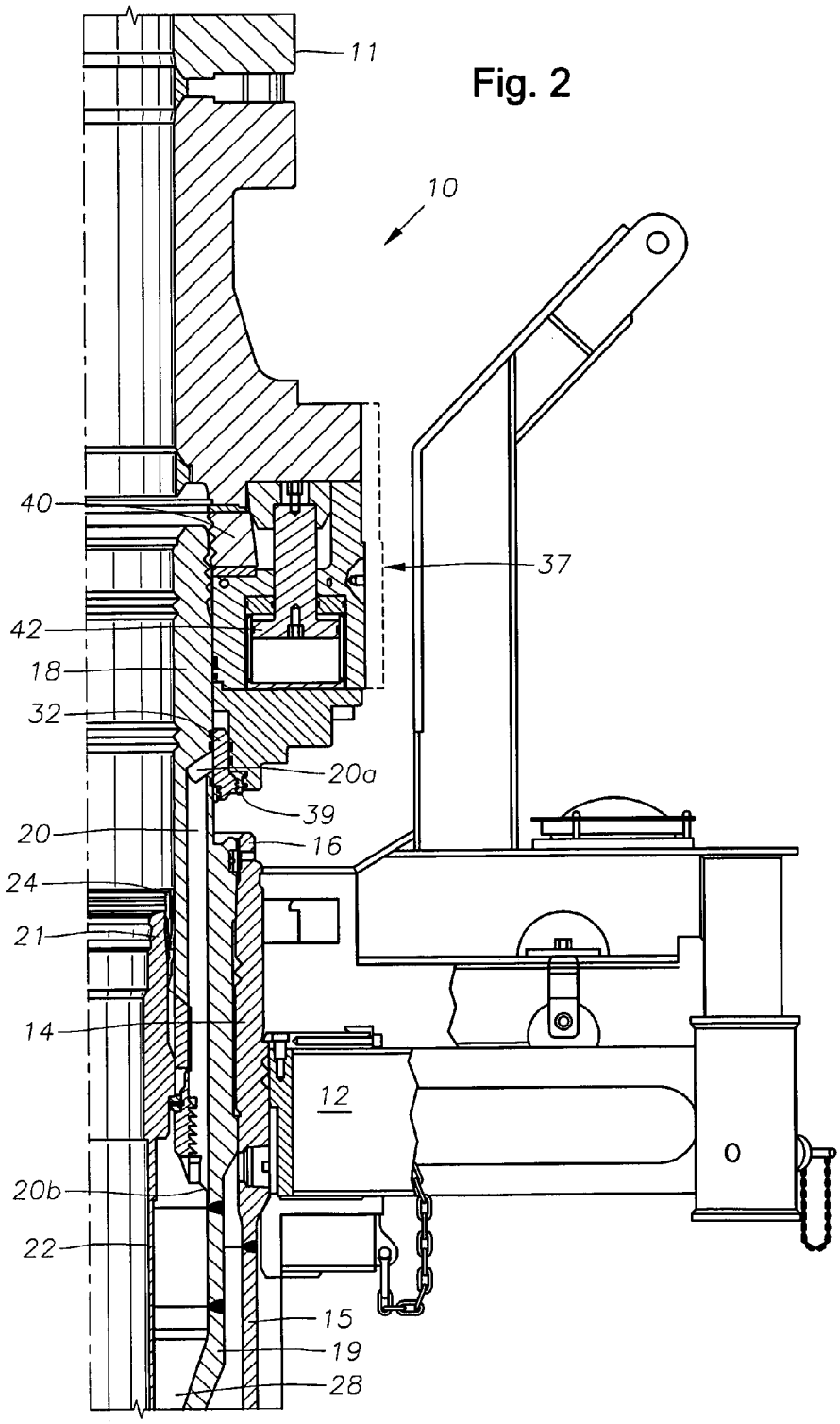
FIG. 2 is a cross section of the injection and monitoring system with the annular ring shown in a closed position.

Referring to FIGS. 1 and 2, a subsea well injection and monitoring system 10, for injecting drill cuttings, heavy fluids, and monitoring casing annulus pressure, is shown. A wellhead receptacle or guide base 12 is located on the sea floor. A low pressure wellhead housing 14, or outer wellhead tubular member, is landed within wellhead receptacle 12. The low pressure wellhead housing 14 has an upper rim 16. Conductor pipe 15 extends downward from low pressure wellhead housing 14 to a selected depth in the well. A high pressure wellhead housing 18, inner wellhead tubular member, is landed within the low pressure wellhead housing 14. High pressure wellhead housing 18 supports outer casing 19, which extends downward from a lower end of high pressure wellhead housing 18 to a second and deeper depth in the well.

A casing hanger 21 secured to the upper end of an inner string of casing 22 is landed within high pressure wellhead housing 18 and sealed by a packoff or casing hanger seal 24. Casing 22 extends into the well to a greater depth than outer casing 19 and is cemented in place. An annulus 28 is defined between inner casing 22 and outer casing 19. Only a portion of annulus 28 is filled with cement, leaving an upper portion for injecting either a slurry of cuttings from another well into porous earth formations, or heavy fluids to help maintain the integrity of the casing annulus.

One or more passages 20 are formed within the wall of high pressure wellhead housing 18. Each passage 20 extends parallel to the axis of wellhead housing 18 and has an upper end **20*a* in communication with an exterior surface of high pressure wellhead housing 18. Upper end 20*a* extends above upper rim 16 of low pressure wellhead housing 14 and above packoff 24 of casing hanger 21. Passage 20 has a lower end 20*b* in communication with an inner surface of high pressure wellhead housing 18 and with annulus 28. In the preferred embodiment, passages 20** may be used for injecting cuttings. In another embodiment, a pressure transducer (not shown) can also be placed in fluid communication with upper end

20*a* in a manner know to those skilled in the art, so that passage 20 can also be used for monitoring casing annulus pressure. Lower end 20*b* extends below packoff 24 of casing hanger 21. A check valve 23 may be located in passage 20 to prevent back flow of cuttings slurry.

Figure 3:
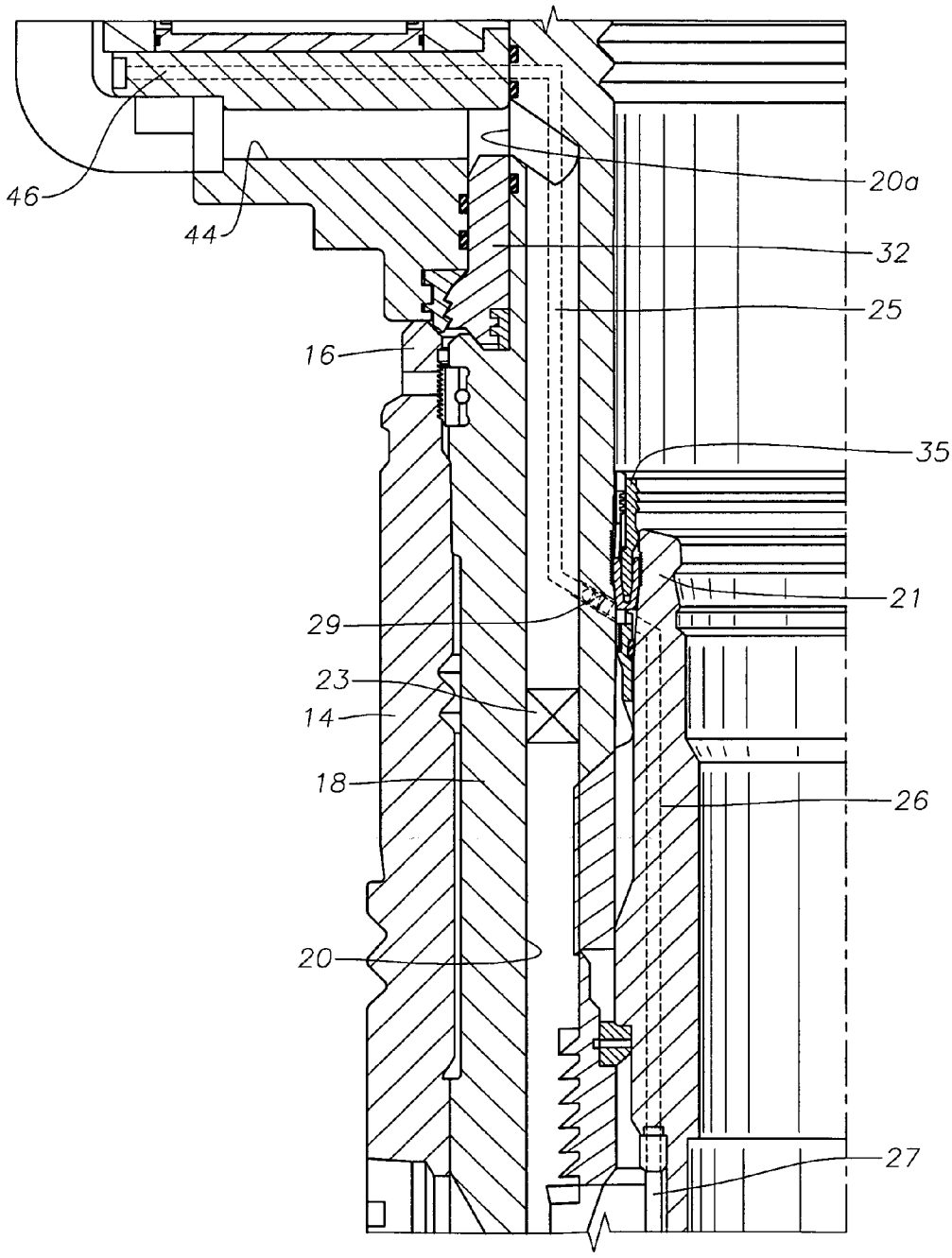
FIG. 3 is an enlarged view of a portion of the injection and monitoring system shown in FIG. 1.
Figure 4:
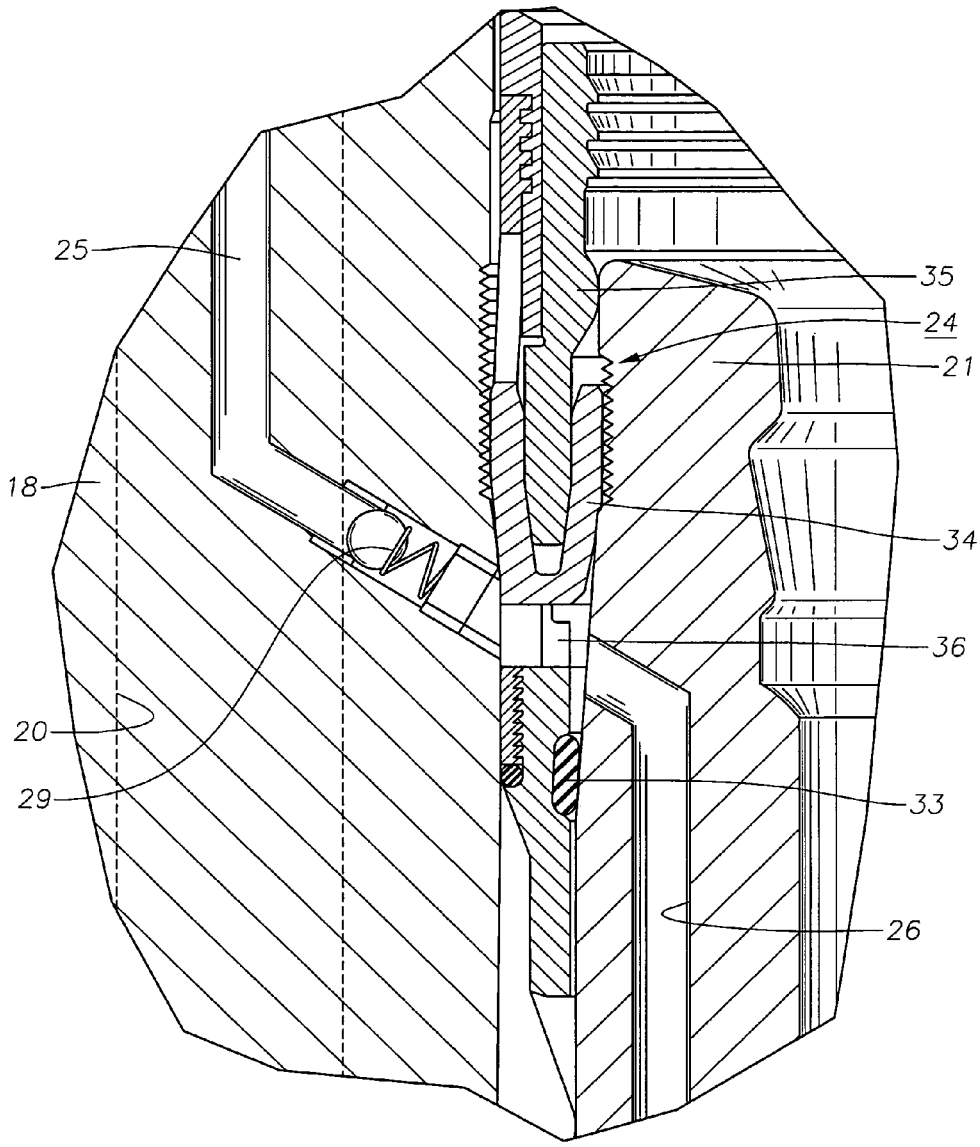
FIG. 4 is a further enlarged view of a portion of the injection and monitoring system shown in FIG. 1.

Referring also to FIGS. 3 and 4, one or more wash passages 25, or upper channels, extend through high pressure wellhead housing 18. Wash passage 25 is parallel to and does not intersect passage 20. Wash passage 25 has an upper end on the exterior of high pressure wellhead housing 18 above packoff 24 and low pressure wellhead housing rim 16. The lower end of wash passage 25 is in the bore of high pressure wellhead housing 18. In the preferred embodiment, packoff 24 has upper and lower sealing portions and the lower end of wash passage 25 is located between the upper and lower sealing portions. As shown in FIG. 4, the lower seal portion is an elastomeric seal 33 located within a metal body. The upper portion comprises a metal-to-metal U-shaped seal 34. Seal 34 is energized by an axially movable energizing ring 35. A hole 36 extends through the body of packoff 24 between seals 33 and 34. Hole 36 communicates wash passage 25 in high pressure wellhead housing 18 with a wash passage 26 in casing hanger 21. A check valve 29 is preferably located in wash passage 25 to prevent back flow of slurry.

Wash passage 26, or lower channel, extends downward within the wall of casing hanger 21 parallel to the axis of casing hanger 21. A tubing 27, or casing hanger tubular member, is secured to the lower end of wash passage 26. Tubing 27 is strapped to the exterior of casing 22 within casing annulus 28 and extends to a selected depth above the level of cement in casing annulus 28. In the preferred embodiment, tubing 27 allows a liquid to be pumped from the surface to a lower portion of annulus 28. Alternatively, a pressure transducer (not shown) can also be placed in fluid communication with wash passage 26 in a manner know to those skilled in the art, so that passages 25, 26 can also be used for monitoring casing annulus pressure.

A seal ring 32 is mounted to the exterior of high pressure wellhead housing 18 above low pressure wellhead housing 14. Seal ring 32 is axially movable, permitting it to be shifted upward and downward, thus closing and opening the upper end 20*b* of passage 20 as wells as wash passage 25. FIGS. 1 and 3 show ring 32 in a lower open position while FIG. 2 shows ring 32 in an upper closed position.

A connector assembly 37 is lowered on a riser 11. Connector assembly 37 is typically used for injecting fluids into casing annulus 28, but may also be used for monitoring the pressure in annulus 28. Connector assembly 37 has a body that engages ring 32 when landing on the upper end of high pressure wellhead housing 18. Upon engagement, ring 32 is shifted downward to the open position. A latch 39 is mounted to connector 37 for engaging ring 32. Typically, latch 39 has a plurality of teeth that engage with a plurality of grooves located on ring 32. When connector 37 is moved back upward, as shown in FIG. 2, latch 39 draws ring 32 back upward to the closed position.

Connector 37 has locking elements 40 that move radially inward and connect to grooves formed on the mandrel or upper end of high pressure wellhead housing 18. At least one axially movable piston 42 moves locking elements 40 inward. Other types of connections between connector 37 and high pressure wellhead housing 18 are feasible. A line 38 extends downward to connector 37 for delivering a slurry of cuttings. Line 38 may extend alongside or within the riser 11. Line 38 registers with a passage 44 extending through connector 37 to an inner diameter portion. The inner diameter of the body of connector 37 slides sealingly over ring 32, and the outlet of passage 44 locates above ring 32. An annular chamber is created above ring 32 that communicates the outlet of passage 44 with upper end 20*a* of passage 20. A wash passage 46, or connector channel, extends through connector 37 into alignment with wash passage 25 in high pressure wellhead housing 18. In the one embodiment, a pressure transducer (not shown) would typically be placed on connector 37, in communication with passage 44, in order to have a pressure transducer in fluid communication with passage 20 for monitoring casing annulus pressure. In another embodiment, a pressure transducer (not shown) would typically be placed on connector 37, in communication with passage 46, in order to have a pressure transducer in fluid communication with wash passages 25, 26 for monitoring casing annulus pressure.

In operation, a wellhead receptacle 12 is located on the sea floor. After drilling the well to a first depth, low pressure wellhead housing 14 and conductor 15 are lowered into the receptacle 12. An operator then drills through conductor 15 to a selected depth. High pressure wellhead housing 18 is lowered with outer casing 19 and cemented in place. Ring 32 will be in the upper closed position shown in FIG. 2. The well is drilled to an even greater depth. Casing hanger 21 is lowered with casing 22 and cemented in place, leaving an annulus 28 between casings 19 and 22. Tubing 27 is strapped to casing 22 during the installation of casing 22. Connector 37 is lowered onto high pressure wellhead housing 18 and secured by locking elements 40. As it lands, it will push ring 32 downward to the open position, shown in FIGS. 1 and 3.

When it is desired to dispose of cuttings from another well, the cuttings are mixed in a slurry and pumped down line 38. The cuttings pass through passages 44 and 20 and flow into casing annulus 28. At the same time, water may be injected through passages 46, 25 and 26 and down tubing 27. The water flows upward in annulus 28 to prevent bridging of the cuttings flowing downward. The connector assembly 37 can be lifted off the high pressure wellhead housing 18 when no further cuttings are desired to be deposited. As seen in FIG. 2 when connector assembly 37 is lifted off of high pressure wellhead housing 18, connector assembly 37 engages latch 39 on the ring 32 and moves ring 32 up to the closed position. Latch 39 disengages from ring 32 as connector 37 is retrieved.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein or in the steps or in the sequence of steps of the methods described herein without departing from the spirit and the scope of the invention as described.

What is claimed is:

1. A subsea wellhead assembly comprising:

a tubular wellhead member having an exterior grooved profile and having an axis extending therethough;

a passage extending through the wellhead member from an opening on an exterior portion of the wellhead member for communicating with a casing annulus;

a wellhead connector adapted to be connected to a riser, that connects to the profile of the wellhead member, the wellhead connector connecting substantially coaxially with the tubular wellhead member;

a communicator port extending through a side of the wellhead connector, which registers with the opening of the passage; and a seal ring located below the exterior profile, the seal ring slidingly engaging the wellhead member and being movable between an upper position and a lower position, the seal ring sealingly closes the opening of the passage while in its upper position and opens the opening of the passage when the seal ring is in its lower position.

2. The subsea wellhead assembly of claim 1, further comprising a line attached to the communication port for the delivery of a fluid to the casing annulus.

3. The subsea wellhead assembly of claim 1, wherein the wellhead connector engages the seal ring and actuates the seal ring between the upper and lower positions.

4. The subsea wellhead assembly of claim 1, wherein the wellhead connector further comprises:

a locking element that selectively engages the exterior profile wellhead member;

a piston that selectively actuates the locking element into and out of engagement with the exterior profile, wherein the piston actuates the seal ring into its lower position when the piston actuates the locking element into engagement with the upper portion of the wellhead member.

5. A subsea wellhead assembly comprising:

an outer wellhead housing;

an inner wellhead housing landed in the outer wellhead housing having an exterior profile formed on an upper portion;

a passage extending through the inner wellhead housing from a casing annulus to an opening located on the upper portion of the inner wellhead housing for communicating with the casing annulus;

a wellhead connector adapted to be connected to a riser, having a lower portion that connects to the upper portion of the inner wellhead housing;

a communicator ring that is attached to a lower portion of the wellhead connector; and a communicator port formed in the communicator ring extending through a side of the communicator ring, which aligns with the opening in the passage so that the casing annulus is in fluid communication with the side of the communicator ring.

6. The subsea wellhead assembly of claim 5, further comprising a line attached to the communication port for the delivery of a fluid to the casing annulus.

7. The subsea wellhead assembly of claim 5, further comprising:

a seal ring located between the exterior profile, the seal ring slidingly engaging the inner wellhead housing and movable between an upper position and a lower position, the seal ring sealingly closes the opening of the passage while in its upper position and opens the opening of the passage when the seal ring is in its lower position.

8. The subsea wellhead assembly of claim 7, wherein the wellhead connector ring engages the seal ring and actuates the seal ring between the upper and lower positions.

9. The subsea wellhead assembly of claim 8, wherein the wellhead connector further comprises:

a locking element that selectively engages the exterior profile of the inner wellhead housing; and a piston that selectively actuates the locking element into and out of engagement with the exterior profile, the piston selectively actuates the connector ring which actuates the seal ring when the piston actuates the locking element into engagement with the exterior profile.

10. The subsea wellhead assembly of claim 9, wherein the wellhead connector actuates the connector ring which in turn pushes the seal ring into its lower position when piston actuates the locking element into engagement with the upper portion of the inner wellhead housing.

11. The subsea wellhead assembly of claim 10, further comprising:

a plurality of grooves formed on the exterior surface of the seal ring; and a plurality of teeth formed on the lower portion of the connector ring that matingly engage the grooves, such that the connector ring pulls the seal ring to its upper position when the piston actuates the locking element out of engagement with the exterior profile.

12. The subsea wellhead assembly of claim 5, further comprising:

an upper channel extending from the upper portion of the inner wellhead housing to the an inner surface of the inner wellhead housing;

a casing hanger landed in the inner wellhead housing, the casing hanger having an outer surface; and a lower channel that aligns with the upper channel and extends from the outer surface of the casing hanger to a lower portion of the casing hanger so that the upper and lower channels are in fluid communication with the casing annulus.

13. The subsea wellhead assembly of claim 12, further comprising a line attached to the communication port for the delivery of a fluid to the casing annulus.

14. The subsea wellhead assembly of claim 12, further comprising a casing hanger tubular member that is connected to the lower portion of the casing hanger in fluid communication with the lower channel for delivery of a fluid to the casing annulus at a depth below the casing hanger.

15. The subsea wellhead assembly of claim 14, wherein the casing hanger tubular member extends to a predetermined depth for delivery of a fluid in the casing annulus below the predetermined depth.

16. A method for communicating with a casing annulus of a wellhead assembly, comprising the following steps:

providing a wellhead member having a passage extending from its outer surface to a casing annulus;

providing a wellhead connector with a communication port extending laterally through a side of the wellhead connector;

providing a seal ring located below an exterior profile of the wellhead member, the seal ring slidingly engaging the wellhead member and moving between an upper position and a lower position, the seal ring sealingly closing the opening of the passage while in its upper position and opening the opening of the passage when the seal ring is in its lower position; then attaching a riser to the wellhead connector;

landing the wellhead connector on the wellhead member;

and then sealingly engaging the communication port with the passage.

17. The method for communicating of claim 16, further comprising the step of injecting a fluid into the casing annulus from a line connected to the communication port on the wellhead connector.

18. The method for communication of claim 16, further comprising the step of monitoring the pressure in the casing annulus with a pressure transducer connected to the wellhead connector.

19. The method for communication of claim 16, further comprising the steps:

providing a casing annulus tubular member extending from a casing hanger to a predetermined depth, that is in fluid communication with the wellhead connector; and then delivering a fluid to the casing annulus at the predetermined depth through wellhead connector and the casing hanger tubular member.

* * * * *

UNITED STATES PATENT AND TRADEMARK OFFICE

CERTIFICATE OF CORRECTION

PATENT NO. : 7,044,227 B2
APPLICATION NO. : 10/315717
DATED : May 16, 2006
INVENTOR(S) : Charles E. Jennings et al.

It is certified that error appears in the above-identified patent and that said Letters Patent is hereby corrected as shown below:

Column 5, line 43, delete “wells” and insert - -well- -

Column 8, line 28, delete “the” before “an inner”

Signed and Sealed this

Fifth Day of September, 2006

JON W. DUDAS
*Director of the United States Patent and Trademark Office*